US006576854B2

(12) United States Patent
Yamanaka et al.

(10) Patent No.: US 6,576,854 B2
(45) Date of Patent: Jun. 10, 2003

(54) WATERPROOF SWITCH

(75) Inventors: Makoto Yamanaka, Ichikawa (JP); Yutaka Sekino, Hadano (JP)

(73) Assignees: Niles Parts Co., Ltd., Tokyo (JP); Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 09/968,825

(22) Filed: Oct. 2, 2001

(65) Prior Publication Data

US 2002/0079206 A1 Jun. 27, 2002

(30) Foreign Application Priority Data

Dec. 6, 2000 (JP) ..... 2000-372070

(51) Int. Cl.[7] ..... H01H 9/02
(52) U.S. Cl. ..... 200/302.1; 200/306
(58) Field of Search ..... 200/61.62, 61.76–61.82, 200/295, 296, 302.1, 302.2, 302.3, 303, 306

(56) References Cited

U.S. PATENT DOCUMENTS 3,586,810 A * 6/1971 Brown ..... 200/302.2
5,008,505 A * 4/1991 Takano et al. ..... 200/531
5,063,277 A * 11/1991 Takano et al. ..... 200/302.2 X
5,682,978 A * 11/1997 Kawase ..... 200/302.1
6,271,490 B1 * 8/2001 Miyata ..... 200/302.1

FOREIGN PATENT DOCUMENTS

JP 2000-177397 6/2000

* cited by examiner

*Primary Examiner*—J. R. Scott
(74) *Attorney, Agent, or Firm*—Jordan and Hamburg LLP

(57) ABSTRACT

The invention provides a waterproof switch which can electrically open and close an door of a vehicle body by a switch, can achieve a seal between a waterproof switch and a panel and a seal against an inner portion of the waterproof switch by one seal member, and previously make a seal member hold in a side of the waterproof switch at a time of assembling. The waterproof switch comprises: a base (1) having a seal surface (17); a push rod (3) moving against an urging force so as to open or close a contact point; a seal member (5) having a head cover portion (31), a panel seal portion (33) and a base seal portion (35); and a case (7) provided with a mounting and engaging portion (37), and a seal assist portion (39) pressing the base seal portion (35) to the seal surface (17) of the base (1) in a mounting state of the mounting and engaging portion (37) and closely attaching the panel seal portion (33) to a panel (OP) at a time of supporting the panel seal portion (33) so as to mount the base (1) to a side of the panel (OP).

18 Claims, 3 Drawing Sheets

WATERPROOF SWITCH

BACKGROUND OF THE INVENTION

1. Field of the Invention

The present invention relates to a waterproof switch used in an door such as a tail gate, a backdoor, a trunk lid and the like of a motor vehicle.

2. Description of the Related Art

As a mechanism for opening and closing the tail gate, the backdoor or the like, for example, there has been conventionally a structure shown in FIG. 1 which corresponds to a structure described in Japanese Patent Application Laid-Open No. 2000-177397. FIG. 1 is a cross sectional view showing an opening and closing mechanism of a tail gate for opening and closing a rear opening of a motor vehicle.

As shown in FIG. 1, a tail gate 101 forms a closed sectional structure by combining an outer panel OP and an inner panel IP, and has a lock apparatus 103 in a lower portion thereof. The lock apparatus 103 is structured such that a latch is engaged with and disengaged from a striker 107 provided in a rear opening 105 of a vehicle body, whereby the lock apparatus 103 can lock the tail gate 101 and cancel the lock of the tail gate 101 with respect to a side of the vehicle body. An operation handle 109 is supported to the tail gate 101. The operation handle 109 and the lock apparatus 103 are interlocked by a connecting rod 111.

Accordingly, by operating the operation handle 109, it is possible to interlock the lock apparatus 103 via the connecting rod 111, cancel an engagement of the latch with respect to the striker 107 and cancel the lock of the tail gate 101.

However, as mentioned above, in the structure that the lock is canceled by the operation handle 109 formed by the link connection, a play is easily generated and an operating load of the operation handle 109 becomes great. Further, a weight is increased due to a weight of the operation handle 109 and the connection rod 111.

On the contrary, when the lock apparatus 103 is structured such as to be driven by a solenoid, a waterproof switch is provided in place of the operation handle 109 and the lock and the lock cancellation of the lock apparatus 103 are executed by the waterproof switch, it is possible to restrict the play, reduce the operation load and further reduce the weight as a whole, as is different from the link connection.

However, in the case of the structure in which the lock apparatus 103 is electrically operated by the waterproof switch, a waterproof property of the waterproof switch comes into problem.

That is, with respect to a penetration from an outer side of the outer panel OP, not only is it necessary to waterproof between the waterproof switch and the outer panel OP, but also it is necessary to achieve a waterproof function when the water penetrating between the outer panel OP and the inner panel IP from other portions is applied to the waterproof switch therewithin.

Accordingly, a seal member such as an O-ring or the like is required within and out of the outer panel OP, so that a number of the parts is increased, and it becomes troublesome to assemble and control the parts, whereby a cost is increased.

SUMMARY OF THE INVENTION

An object of the present invention is to provide a waterproof switch which can electrically open and close an opening and closing body of a vehicle body, for example, in the manner mentioned above, having a seal member for proofing water hold in a side of the waterproof switch, and can sufficiently proof water within and out of a panel without increasing a number of parts.

In accordance with a first aspect of the present invention, there is provided a waterproof switch comprising:

a base mounted to a panel constituting an door of a vehicle body and provided with a seal surface;

a push rod supported to the base and having a head portion facing from a hole of the panel, the head portion being pressed, thereby moving against an urging force so as to open or close a contact point;

a seal member provided with a head cover portion covering a head portion of the push rod, a panel seal portion opposing to the panel around the hole of the panel, and a base seal portion disposed in the panel seal portion with an interval and opposing to a seal surface of the base around the push rod; and a case provided with a mounting and engaging portion mounted to the base in such a manner as to freely engage with and disengage from the base, and a seal assist portion interposed between a panel seal portion and a base seal portion in the seal member, pressing the base seal portion to a seal surface of the base in a mounting state of the mounting and engaging portion and closely attaching the panel seal portion to the panel at a time of supporting the panel seal portion so as to mount the base to a side of the panel.

In accordance with a second aspect of the present invention, there is provided a waterproof switch as recited in the first aspect, further comprising an engagement hole provided in one of the mounting and engaging portion of the case and the base and an engagement convex portion provided in the other, wherein the case is slid with respect to the base so as to engage the engagement hole with the engagement convex portion, and the seal assist portion presses the base seal portion to the seal surface of the base.

In accordance with a third aspect of the present invention, there is provided a waterproof switch as recited in the second aspect, wherein the seal assist portion of the case is constituted by a flange-shaped panel seal assist portion closely in contact with the panel seal portion, and an orbital-shaped base seal assist portion protruding from the panel seal assist portion and having a front end pressing the base seal portion.

In accordance with a fourth aspect of the present invention, there is provided a waterproof switch as recited in the third aspect, wherein the case has a drain hole communicating with an outer peripheral side of the base seal assist portion.

In accordance with a fifth aspect of the present invention, there is provided a waterproof switch as recited in any one of the first to fourth aspects, wherein the panel seal portion of the seal member has a crushed margin in an outer peripheral side of a surface opposing to the panel.

In accordance with the first aspect of the invention, the seal member is provided with the head cover portion covering the head portion of the push rod of the waterproof switch, the panel seal portion opposing to the panel around the hole of the panel to which the waterproof switch is mounted, and the base seal portion disposed in the panel seal portion with an interval and opposing to the seal surface of the base around the push rod, the seal assist portion of the case is interposed between the panel seal portion of the seal member and the base seal portion, the mounting and engaging portion of the case is mounted to the base in such a manner as to freely engage with and disengage from the base. The seal assist portion presses the base seal portion to the seal surface of the base in this mounting state, supports the panel seal portion and closely attaches the panel seal portion to the panel at a time of mounting the base to the side of the panel so as to establish a seal.

In the manner mentioned above, since the head portion of the push rod is covered by the head cover portion, the panel seal portion is closely in contact with the panel in the periphery of the hole of the panel so as to establish the seal. The base seal portion is pressed to the seal surface of the base so as to establish the seal. The water which is going to penetrate from an external portion of the hole of the panel facing to the head portion of the push rod can be waterproofed by the head cover portion and the panel seal portion. Further, with respect to the water penetrating to an inner portion of the panel from the other portions, it is possible to waterproof by the base seal portion. Accordingly, it is possible to sufficiently achieve a waterproof inside and outside the panel.

Further, since the head cover portion, the panel seal portion and the base seal portion can be integrally formed as the seal member, a number of the parts can be reduced, it becomes easy to control parts and assemble, and it is possible to reduce a cost.

Further, since the seal member can be held by attaching the case to the base before attaching the waterproof switch to the side of panel, an assembling operation can be executed in a significantly easy manner.

Further, when the lock apparatus provided in the door of the vehicle body is electrically locked or cancelled from the locked state by the waterproof switch, the play becomes significantly less than that of the link connection, it is possible to reduce an operating force and it is possible to reduce the weight.

In accordance with the second aspect of the invention, in addition to the effect of the first aspect, since the waterproof switch has the engagement hole provided in one of the mounting and engaging portion of the case and the base and the engagement convex portion provided in the other. The case is slid with respect to the base so as to engage the engagement hole with the engagement convex portion, and the seal assist portion presses the base seal portion to the seal surface of the base, it is possible to securely make the assembly of the seal member easy and it is possible to securely waterproof in the side of the inner portion of the panel.

In accordance with the third aspect of the invention, in addition to the effect of the second aspect, since the seal assist portion of the case is constituted by the flange-shaped panel seal assist portion closely in contact with the panel seal portion, and the orbital-shaped base seal assist portion protruding from the panel seal assist portion and having the front end pressing the base seal portion, it is possible to securely press the base seal portion by the seal surface of the base by means of the orbital-shaped base seal assist portion when attaching the case to the base. Further, when attaching the base to the side of the panel, it is possible to securely bring the panel seal portion into close contact with the side of the panel by an assistance of the panel seal assist portion. Accordingly, it is possible to more securely achieve a waterproof function.

In accordance with the fourth aspect of the invention, in addition to the effect of the third aspect, since the case has the drain hole communicating with the outer peripheral side of the base seal assist portion, the water penetrating to the outer peripheral side of the base seal assist portion is discharged to the external portion from the drain hole, and it is possible to restrict a secondary problem caused by the water stored in the portion mentioned above.

In accordance with the invention as recited in the fifth aspect, in addition to the effect of the invention as recited in any one of the first to fourth aspects, since the panel seal portion of the seal member has the crushed margin in the outer peripheral side of the surface opposing to the panel, the crushed margin is crushed at a time of closely bringing the panel seal portion into contact with the panel, whereby it is possible to achieve a secure waterproof.

DESCRIPTION OF THE PREFERRED EMBODIMENT

Figure 1:
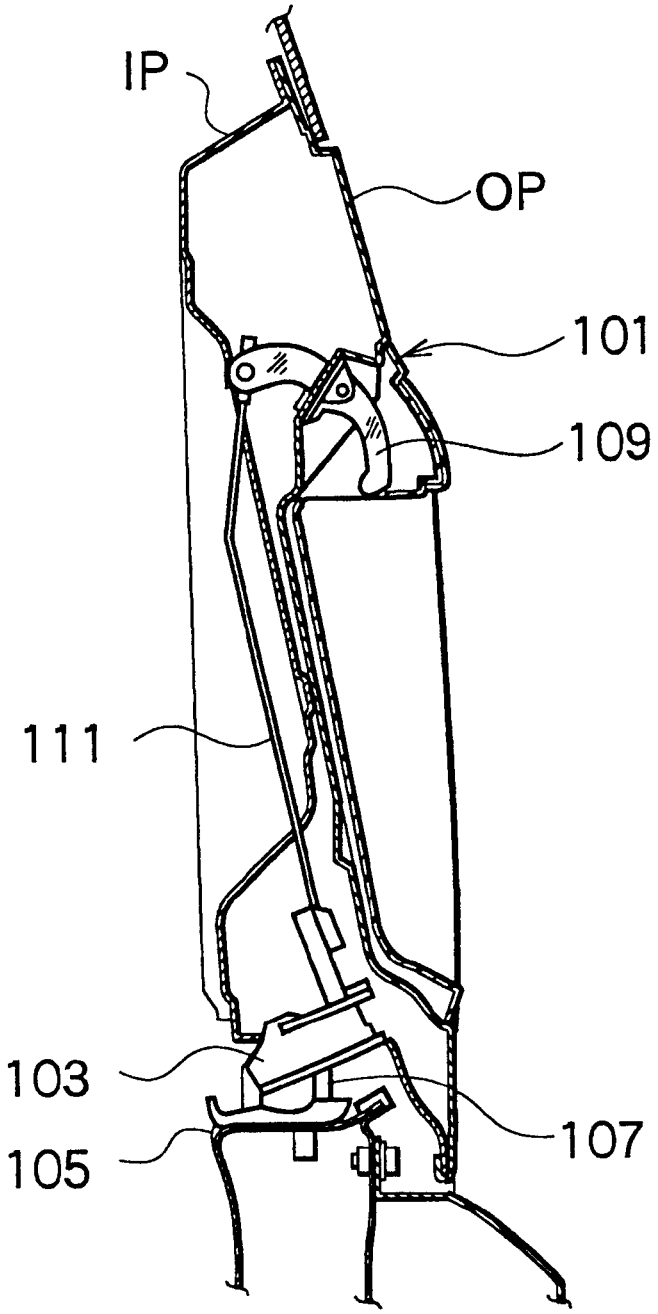
FIG.1 PRIOR ART
FIG. 1 is a cross sectional view of a tail gate in accordance with a conventional embodiment.
Figure 2:
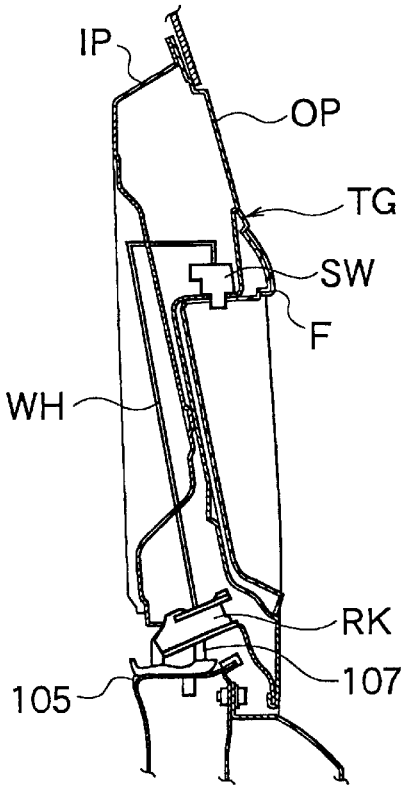
FIG. 2 is a cross sectional view of a tail gate showing an arranging state of a waterproof switch in accordance with an embodiment of the present invention.
Figure 3:
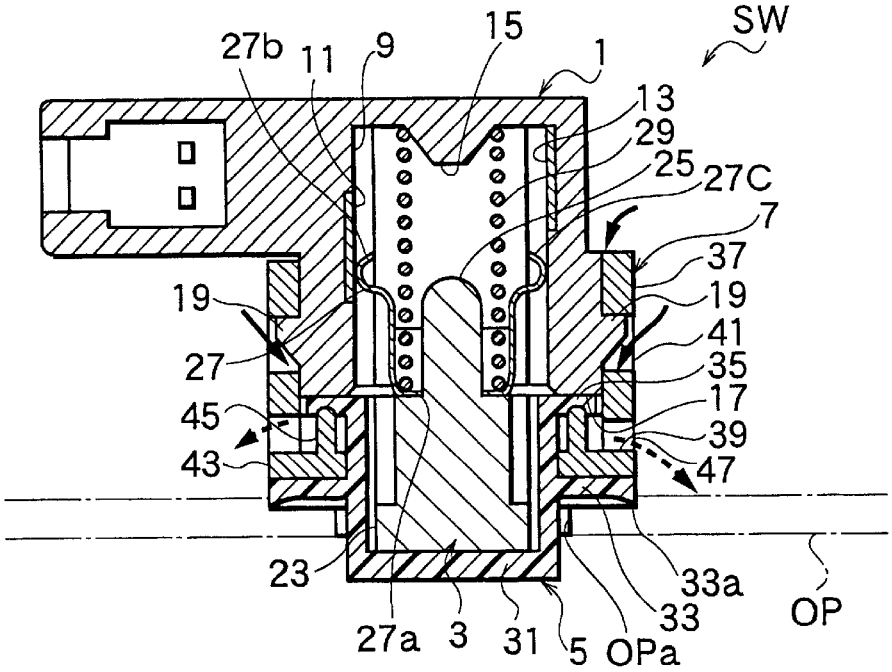
FIG. 3 is a cross sectional view of a waterproof switch in accordance with an embodiment of the present invention.
Figure 4:
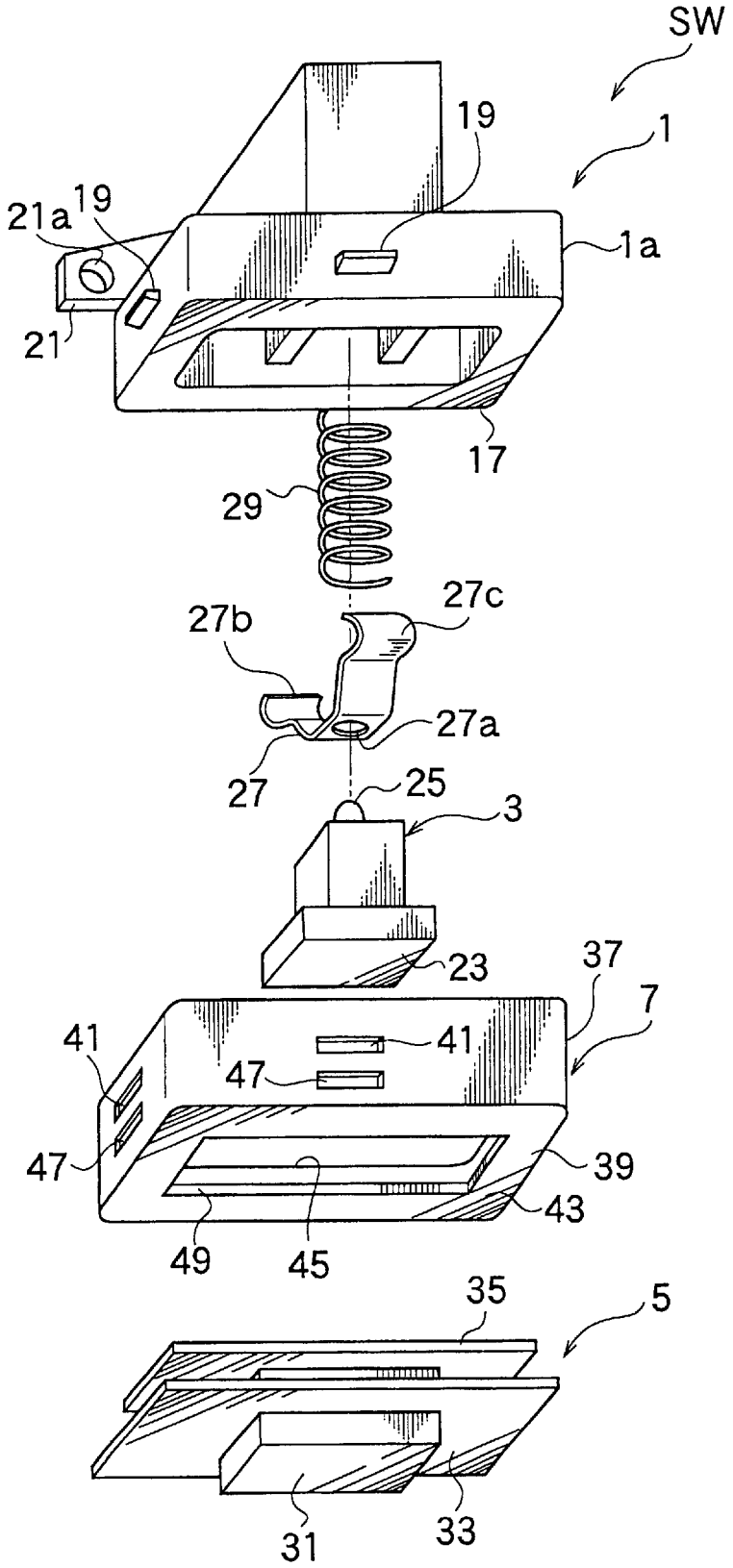
FIG. 4 is an exploded perspective view of a water switch in accordance with an embodiment.

FIGS. 2 to 4 show an embodiment in accordance with the present invention, in which FIG. 2 is a perspective view of a rear portion of a motor vehicle showing a mounting position, FIG. 3 is a cross sectional view of a mounting state and FIG. 4 is an exploded perspective view.

At first, as shown in FIG. 2, a waterproof switch in accordance with an embodiment of the present invention is structured such that an opening and closing operation switch SW. The opening and closing operation switch SW is attached to a tail gate TG serving as an door of a vehicle body so as to open and close a rear opening of a motor vehicle. In this case, the opening and closing operation switch SW can be also provided as an opening and closing operation switch for a backdoor, a trunk lid and a side door. The tail gate TG is structured such that a main body is constituted by an outer panel OP and an inner panel IP, and the opening and closing operation switch SW is attached to a side of the outer panel OP corresponding to a panel. The opening and closing operation switch SW and a lock apparatus RK are electrically connected by a harness WH and is structured such as to drive a latch by a solenoid or a motor in the lock apparatus RK on the basis of an operation of the opening and closing operation switch SW and cancel an engagement of a vehicle body opening 105 with a striker 107, thereby canceling a locking state of the tail gate TG.

In this case, reference symbol F denotes a finisher trimming a periphery of a license plate attached to a concave portion formed below the tail gate TG.

The opening and closing operation switch SW is provided with a base 1, a push rod 3, a seal member 5 and a case 7, as shown in FIGS. 3 and 4. The base 1 is formed by a synthetic resin such as a nylon or the like, and is provided with a support hole 9 in which the push rod 3 is supported so as to freely move forward and backward. A pair of terminals 11 and 13 are assembled in an inner surface of the support hole 9 in accordance with an insert molding. A spring receiving convex portion 15 is projected from a back side of the support hole 9.

A seal surface 17 is provided around an opening side of the support hole 9. Engaging convex portions 19 are provided on an outer surface of the base 1, for example, at four portions. Further, a mounting portion 21 is projected from the base 1 A through hole 21*a* for screwing is provided in the mounting portion 21.

The push rod 3 has a head portion 23 and a spring support convex portion 25. The head portion 23 is formed in a rectangular shape, and the spring support convex portion 25 is protruded in a columnar shape. A support hole 27*a* of a leaf spring 27 is fitted to the spring support convex portion 25. Contact portions 27*b* and 27*c* are provided in the leaf spring 27. In a state shown in FIG. 3, one contact portion 27*b* is in contact with one terminal 11 within the support hole 9, and another contact portion 27*c* is in contact with an inner wall surface of the support hole 9 at a position out of another terminal 13. Further, one end of a coil spring 29 is attached to the spring support convex portion 25 of the push rod 3 so as to be fitted thereto, and another end of the coil spring 29 is attached to the spring receive convex portion 15 so as to be fitted thereto.

Accordingly, the push rod 3 is supported to the base 1, and is structured such as the head portion 23 facing from a hole OPa of the outer panel OP is pressed, whereby the push rod 3 moves against the urging force of the coil spring 29, and the contact portions 27*b* and 27*c* are brought into contact with the terminals 11 and 13, whereby the push rod 3 opens or closes the contact point.

The seal member 5 is provided with a head cover portion 31, a panel seal portion 33 and a base seal portion 35, and is integrally formed by an elastic body such as a rubber or the like. The head cover portion 31 is formed in a shape covering the head portion 23 of the push rod 3. The panel seal portion 33 is structured such as to oppose to and be closely in contact with the outer panel OP in the periphery of the hole OPa of the outer panel OP. A rib 33*a* corresponding to a crushed margin is provided in the panel seal portion 33 all around the circumference in an outer peripheral side of a surface opposing to the outer panel OP.

The base seal portion 35 is provided in parallel to the panel seal portion 33 with an interval, and is provided in an outer periphery of an opening end of the head cover portion 31. The base seal portion 35 is structured such as to oppose to and be closely in contact with the seal surface 17 of the base 1 in the periphery of the push rod 3.

The case 7 is structured such that a mounting and engaging portion 37 and a seal assist portion 39 are integrally formed by a resin such as a nylon or the like. The mounting and engaging portion 37 is structured such as to be fitted to an outer periphery of a barrel portion 1*a* of the base 1, and is provided with engaging holes 41 engaging with the engaging convex portion 19 at four portions in the periphery thereof.

The seal assist portion 39 is constituted by a flange-like panel seal assist portion 43 being closely in contact with a back surface of the panel seal portion 33, and a base seal assist portion 45 protruding from the panel seal assist portion 43 and having a front end formed as an orbital-shaped rib pressing the base seal portion 35.

Further, drain holes 47 communicating with an outer peripheral side of the base seal assist portion 45 are provided in the case 7, for example, at four portions. A front surface of the case 7 forms an opening 49 for fitting the base seal portion 35 of the seal member 5 thereto.

At a time of assembling, at first, the seal member 5 is previously attached before attaching the opening and closing operation switch SW to the back door BD. That is, in an exploded state as shown in FIG. 4, the base seal portion 35 of the seal member 5 is fitted into the case 7 from the opening 49 of the case 7, and the seal assist portion 39 of the case 7 is interposed between the panel seal portion 33 of the seal member 5 and the base seal portion 35 thereof. In this pre-holding state, the panel seal assist portion 43 is brought into contact with a back surface of the panel seal portion 33 in the seal member 5, and a front end of the base seal assist portion 45 is brought into contact with a back surface of the base seal portion 35 in the seal member 5.

Further, one side of the coil spring 29 is fitted and supported to the spring receiving convex portion 15 of the base 1, the mounting hole 27*a* of the leaf spring 27 is fitted to the spring support convex portion 25 of the push rod 3 and the spring support convex portion 25 is fitted to another end side of the coil spring 29, whereby the push rod 3 is temporarily held to the side of the base 1.

Further, the case 7 temporarily holding the seal member 3 is fitted to the barrel portion 1*a* from one side of the base 1 in a pressing manner. At this time, the side of the mounting and engaging portion 37 of the case 7 slides with respect to the barrel portion 1*a* of the base 1, the engaging hole 41 is engaged with the engaging convex portion 19, and the case 7 is fixed to the base 1.

In this state, the base seal portion 35 of the seal member 5 is closely in contact with the seal surface 17 of the base 1 as shown in FIG. 3, and the base seal assist portion 45 slightly eats into the back surface of the base seal portion 35, thereby being in a state of pressing the base seal portion 35 to the seal surface 17. Accordingly, it is possible to secure a sufficient seal performance in the seal surface 17 by the base seal portion 35.

Further, when fixing the mounting portion 21 of the base 1 to the side of the outer panel OP of the tail gate TG by screws or the like, the side of the head portion 23 of the push rod 3 faces from the hole OPa of the outer panel OP as shown in FIG. 3, and the panel seal portion 33 is pressed to the outer panel OP in the periphery of the hole OPa, whereby the crushed margin 33*a* is closely in contact therewith in a crushing manner. Accordingly, it is possible to secure a sufficient seal property in the periphery of the hole OPa of the outer panel OP by the panel seal portion 33.

That is, even if rainwater or water at a time of washing a car is going to penetrate from the hole OPa of the outer panel OP, the panel seal portion 33 is closely in contact with the inner surface side of the outer panel OP, whereby it is possible to securely prevent the rainwater or the like from penetrating. Further, there is a case that the rainwater or the like penetrates to a portion between the outer panel OP and the inner panel IP in the tail gate TG. However, even when the rainwater or the like is applied to the opening and closing operation switch SW within the tail gate TG, the base seal assist portion 45 in the case 7 presses the base seal portion 35 to the seal surface 17 of the base 1, thereby sealing, so that the rainwater or the like does not penetrate into the base 1 and a loose connection or the like is not generated.

Further, when the water penetrates as shown by an arrow in FIG. 3 from a portion between the base 1 and the case 7 due to the seal of the seal surface 17, there is a case that the water is stored in the periphery of the base seal assist portion 45. The water stored in this manner can be discharged as shown by a broken line arrow from the water drain holes 47, whereby it is possible to prevent a secondary problem caused by the water stored in that portion.

When opening the tail gate TG in a mounting state of the opening and closing operation switch SW, the push rod 3 of the opening and closing operation switch SW is pressed at the head portion 23 thereof via the head cover portion 31 of the seal member 5. Due to this pressing operation, the push rod 3 moves against the urging force of the coil spring 29, and the contact portions 27*b* and 27*c* of the leaf spring 27 are simultaneously in contact with the terminals 11 and 13. Due to this contact, the solenoid of the lock apparatus RK or the motor is energized and the latch is driven so as to be taken out from the striker 107, whereby the lock of the tail gate TG is cancelled. At this time, the head cover portion 31 of the seal member 5 is easily bent and does not prevent the push rod 3 from being pressed.

When canceling the pressing operation of the opening and closing operation switch SW, the push rod 3 is pressed out due to a restoring force of the coil spring 29 and can be easily returned to the state shown in FIG. 3. Due to this return, when closing the tail gate TG, the latch is engaged with the striker 107 and can be again in the lock state.

As mentioned above, in accordance with the present embodiment, it is possible to previously support the seal member 5 to the side of the base 1 via the case 7 before mounting the opening and closing operation switch SW to the outer panel OP of the tail gate TG, so that it is possible to significantly easily perform the mounting operation of the opening and closing operation switch SW to the tail gate TG. Further, since one seal member 5 achieves the seal between the outer panel OP and the opening and closing operation switch SW and the waterproof against the opening and closing operation switch SW within the tail gate TG, the number of the parts can be reduced, it is possible to easily control and mount the parts, and it is possible to reduce the cost.

Further, since the lock apparatus RK provided in the tail gate TG corresponding to the door of the vehicle body is electrically locked and cancelled from the locked state by the opening and closing operation switch SW, the play is significantly reduced in comparison with the link-connection, it is possible to reduce the operating force and it is possible to reduce the weight.

In this case, in the embodiment mentioned above, the description is given of the embodiment in which the opening and closing switch SW is directly mounted to the outer panel OP of the tail gate TG, however, the structure is not limited to this, and the opening and closing switch SW may be mounted to a finisher F or the like provided in the outer panel OP. Accordingly, the constituting element described as the panel in the aspects in accordance with the present invention is not limited to the outer panel and the inner panel themselves constituting the door, and can include the other members such as a finisher, an escutcheon, a trim and the like mounted to the inner panel.

Further, the waterproof switch in accordance with the present invention is not limited to the opening and closing operation switch shown as the embodiment mentioned above, but can be used a so-called door switch for detecting the opening and closing state of various kinds of door including the side door in the motor vehicle.

The present invention may be embodied in other specific forms without departing from the spirit or essential characteristics thereof. The embodiments are therefore to be considered in all respects as illustrative and not respective, the scope of the invention being indicated by the appended claims rather than by the foregoing description, and all changes which come within the meaning and range of equivalency of the clams are therefore intended to be embraced therein.

What is claimed is:

1. A waterproof switch comprising:

a base mounted to a panel constituting a door of a vehicle body and provided with a seal surface and an inner surface having at least one terminal;

a push rod having a head portion and at least one contact portion, said head portion being movable between a first position where there is contact between the at least one contact portion and the at least one terminal and a second position where there is no contact between the at least one contact portion and the at least one terminal;

a seal member provided with a head cover portion covering said head portion of said push rod, a panel seal portion opposing to said panel around the hole of said panel, and a base seal portion disposed in said panel seal portion with an interval and opposing to a seal surface of said base around said push rod;

a case provided with a mounting and engaging portion mounted to said base in such a manner as to freely engage with and disengage from said base, and a seal assist portion interposed between said panel seal portion and said base seal portion in said seal member, pressing said base seal portion to said seal surface of said base in a mounting state of said mounting and engaging portion and closely attaching said panel seal portion to said panel at a time of supporting said panel seal portion so as to mount said base to a side of the panel; and means for biasing the push rod.

2. A waterproof switch according to claim 1, further comprising an engagement hole provided in one of said mounting and engaging portion of said case and said base and an engagement convex portion provided in the other, wherein said case is slid with respect to said base so as to engage said engagement hole with said engagement convex portion, and said seal assist portion presses said base seal portion to the seal surface of said base.

3. A waterproof switch according to claim 2, wherein the seal assist portion of said case is constituted by a flange-shaped panel seal assist portion closely in contact with said panel seal portion, and an orbital-shaped base seal assist portion protruding from said panel seal assist portion and having a front end pressing said base seal portion.

4. A waterproof switch according to claim 3, wherein said case has a drain hole communicating with an outer peripheral side of said base seal assist portion.

5. A waterproof switch according to claim 1, wherein said panel seal portion of said seal member has a crushed margin in an outer peripheral side of a surface opposing to said panel.

6. A waterproof switch according to claim 2, wherein said panel seal portion of said seal member has a crushed margin in an outer peripheral side of a surface opposing to said panel.

7. A waterproof switch according to claim 3, wherein said panel seal portion of said seal member has a crushed margin in an outer peripheral side of a surface opposing to said panel.

8. A waterproof switch according to claim 4, wherein said panel seal portion of said seal member has a crushed margin in an outer peripheral side of a surface opposing to said panel.

9. A waterproof switch comprising:

a base for mounting to a panel, said base defining a cavity having an inner surface with at least one terminal disposed thereon and a cavity aperture, said base having a base seal surface extending peripherally around said cavity aperture;

a movable member movably disposed in said cavity and having a head portion aligned with said cavity aperture and at least one contact portion, said movable member being movable between a first position where there is contact between the at least one contact portion and the at least one terminal for completing a circuit and a second position where there is no contact between the at least one contact portion and the at least one terminal opening the circuit;

a base cap having a cap aperture defined by a base cap flange which has an outer surface and an inner surface, said base cap being engaged with said base with said cap aperture disposed aligned with said cavity aperture and said inner surface of said base cap flange opposing said base seal surface;

an elastic seal member provided with a head cover portion covering said head portion of said movable member permitting displacement of said movable member between said first position and said second position by deformation of said elastic seal member;

said elastic seal member having first seal flange and a second seal flange extending peripherally from said head cover portion and spaced apart from one another by a flange defined groove; and said elastic seal member being installed with said base cap flange disposed in sealing engagement with said flange defined groove such that said first seal flange provides a seal between said inner surface of said base cap flange and said base seal surface, and said second seal flange contacts said outer surface of said base cap flange to effect a seal between said outer surface of said base cap flange and said panel.

10. A waterproof switch according to claim 9, wherein said second seal flange of said elastic seal member has a crushed margin in an outer peripheral side of a surface opposing to said panel.

11. The waterproof switch according to claim 9, further comprising biasing means for biasing said movable member toward one of said first and second positions.

12. A waterproof switch according to claim 11, wherein said second seal flange of said elastic seal member has a crushed margin in an outer peripheral side of a surface opposing to said panel.

13. The waterproof switch according to claim 11, wherein said inner surface of said base cap flange includes a sealing ridge for compressing said first seal flange to enhance sealing thereby.

14. A waterproof switch according to claim 13, wherein said second seal flange of said elastic seal member has a crushed margin in an outer peripheral side of a surface opposing to said panel.

15. The waterproof switch according to claim 9, wherein said inner surface of said base cap flange includes a sealing ridge for compressing said first seal flange to enhance sealing thereby.

16. A waterproof switch according to claim 15, wherein said second seal flange of said elastic seal member has a crushed margin in an outer peripheral side of a surface opposing to said panel.

17. A waterproof switch according to claim 15, wherein said base cap has a drum hole communicating with an outer peripheral side of said outer surface of said base cap.

18. A waterproof switch according to claim 17, wherein said second seal flange of said elastic seal member has a crushed margin in an outer peripheral side of a surface opposing to said panel.

* * * * *